United States Patent [19]

McVey

[11] Patent Number: 4,559,473

[45] Date of Patent: Dec. 17, 1985

[54] ELECTRODE STRUCTURE FOR HIGH PRESSURE SODIUM VAPOR LAMPS

[75] Inventor: Charles I. McVey, Shaker Heights, Ohio

[73] Assignee: General Electric Company, Schenectady, N.Y.

[21] Appl. No.: 672,858

[22] Filed: Nov. 19, 1984

Related U.S. Application Data

[63] Continuation of Ser. No. 387,394, Jun. 11, 1982, abandoned.

[51] Int. Cl.[4] ..... H01J 61/073; H01J 61/34

[52] U.S. Cl. ..... 313/630; 313/631; 313/633

[58] Field of Search ..... 313/575, 622, 630, 631, 313/633, 310

[56] References Cited

U.S. PATENT DOCUMENTS

| | | | |
|---|---|---|---|
| 3,405,303 | 10/1968 | Koury et al. | 313/630 |
| 3,935,495 | 1/1976 | Scott, Jr. et al. | 313/631 |
| 4,034,252 | 7/1977 | McVey | 313/217 |
| 4,065,691 | 12/1977 | McVey | 313/174 |
| 4,105,908 | 8/1978 | Harding et al. | 313/217 |
| 4,123,685 | 10/1978 | Bhalla | 313/630 X |
| 4,136,227 | 1/1979 | Saito et al. | 313/633 X |
| 4,199,704 | 4/1980 | Varshneya et al. | 313/623 |
| 4,303,848 | 12/1981 | Shimizu et al. | 313/630 X |

FOREIGN PATENT DOCUMENTS

| | | | |
|---|---|---|---|
| 961570 | 6/1964 | United Kingdom | 313/633 |

*Primary Examiner*—David K. Moore
*Assistant Examiner*—K. Wieder
*Attorney, Agent, or Firm*—J. F. McDevitt; Philip L. Schlamp; Fred Jacob

[57] ABSTRACT

An electrode structure for sodium vapor lamps is disclosed having molybdenum metal wire coils wound around a tungsten shank to replace the customary all-tungsten electrode structure in these lamps. The improved electrode structures provide increased initial lumens with acceptable lumen maintenance.

2 Claims, 3 Drawing Figures

ELECTRODE STRUCTURE FOR HIGH PRESSURE SODIUM VAPOR LAMPS

This application is a continuation of application Ser. No. 387,394, filed June 11, 1982, now abandoned.

BACKGROUND OF THE INVENTION

The customary electrode structure used in high pressure sodium vapor lamps consists of a tungsten shank with tungsten coils wound thereon which are generally sealed at each end of a tubular light-transmitting ceramic envelope that further contains an ionizable filling. Lamps of this general type are disclosed in U.S. Pat. Nos. 4,025,812 and 4,065,691, both assigned to the present assignee.

The ceramic arc tube is supported within an outer vitreous envelope or jacket of elongated shape generally provided at one end with the conventional screw base. High pressure sodium vapor lamps are also generally vacuum jacketed in order to conserve heat and maximize efficiency.

The high cost and difficulties experienced with manufacture of the customary all-tungsten electrode structures for high pressure sodium vapor lamps advises suitable replacement of this refractory metal to the extent permitted by the severe lamp operating conditions. The tungsten wire customarily used for manufacture of the coil elements in said electrode structure is prone to surface and internal defects which can produce wire breakage and machine wear during electrode fabrication as well as further difficulties of various kinds in the lamp operation. On the other hand, tungsten is recognized to withstand the very high electrode operating temperatures and corrosive environment that is experienced within the arc tube of these lamps. While some sputtering is experienced with an all-tungsten electrode structure during lamp operation, these electrodes provide an acceptable lumen maintenance over considerable time periods.

SUMMARY OF THE INVENTION

It has now been discovered, surprisingly, that molybdenum electrode coils wound about a tungsten shank do not degrade abnormally as might be expected when serving as the electrode structure in high pressure sodium vapor lamps. Further surprisingly, such improved electrode structure provides increased initial lumens along with acceptable lumen maintenance as compared with an all-tungsten electrode structure under the same lamp operating conditions. It becomes thereby possible to improve the operation of this type lamp without undue modification or added cost in the lamp manufacture.

One preferred embodiment of the presently improved thermionic electrode structure comprises molybdenum metal wire coils wound around the distal end of a tungsten shank wherein said molybdenum wire coils comprise outer and inner superposed helical layers with said inner helical layer having spaced apart turns. Said preferred embodiment further includes a dispersion of mixed oxide emission material between the spaced apart turns of said inner helical coil on one of the electrode structures.

In a further modification of the above preferred electrode structure, the molybdenum wire coils are each wound around the distal end of a tungsten shank and with the winding pitch of said inner helical coil being in the reverse direction from the winding pitch of said outer helical coil. Said reverse winding of the superposed helical coils helps prevent intermeshing between coils that can lead to increased electrode degradation with consequent loss of lumen maintenance. A representative high pressure sodium vapor lamp containing said improvement for operation at a given power input of about 400 watts and at a given lamp voltage drop of about 100 volts thereby comprises:

(a) a tubular light transmitting alumina ceramic arc tube having thermionic electrodes sealed into its ends and a charge of sodium-mercury amalgam in excess of the quantity vaporized in normal operation along with a xenon gas fill to facilitate starting, and (b) an evacuated outer elongated light-transmitting vitreous envelope surrounding said arc tube having a stem press seal at one end through which extends a pair of inleads electrically connected to said thermionic electrodes, (c) said electrodes each comprising a pair of superposed helical coils of refractory metal wound around the distal end of a tungsten shank in reverse winding pitch directions and with the inner helical coils having spaced apart turns, one of said electrodes having a mixed oxide emission material being dispersed in the spaced apart turns of said inner helical coil, wherein said improvement comprises using molybdenum for said helical coils to provide increased initial lumens with acceptable lumen maintenance.

In said improved lamp construction, the preferred emission material is dibarium calcium tungstate.

DETAILED DESCRIPTION OF THE PREFERRED EMBODIMENTS

Figure 1:
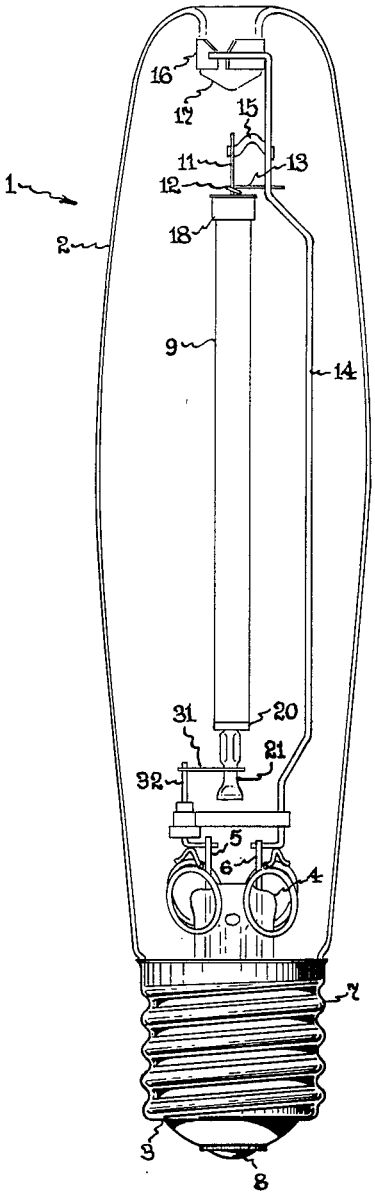
FIG. 1 shows a high pressure sodium vapor lamp embodying the presently improved electrode structure.

Referring to FIG. 1, a high pressure sodium vapor lamp 1 corresponding to a 400 watt size is illustrated which comprises a vitreous outer envelope 2 having a standard mogul screw base 3 attached to one end and comprising a reentrant stem press seal 4 through which extend, in conventional fashion, a pair of relatively heavy lead-in conductors 5 and 6 whose outer ends are connected to the screw shell 7 and eyelet 8 of the base. The inner envelope or arc tube 9 centrally located within said outer envelope comprises a length of light-transmitting ceramic tubing, preferably polycrystalline alumina ceramic which is translucent or which can be single crystal alumina which is clear and transparent. The upper end of the arc tube is closed by an alumina ceramic plug through which extends the niobium inlead wire 11 hermetically sealed. The inlead supports the upper electrode which may be generally similar to the lower electrode later illustrated in the FIG. 2 embodiment. The external portion of inlead 11 passes through a loop 12 in transverse support wire 13 attached to a side rod 14. This arrangement allows for thermal expansion of the arc tube during lamp operation when the lower end seal is rigidly fixed in place, and a resilient metal ribbon 15 assures continued good electrical connection. Side rod 14 is welded to lead-in conductor 6 and has its upper end braced by spring clamp 16 which engages inverted nipple 17 in the dome end of the outer vitreous envelope. A metal reflector band 18 may be desirable around the upper end of the arc tube in order to maintain the desired temperature at the upper end seal, particularly in smaller sizes of lamps such as 250 watts or less. The lower end closure and electrode support assembly for said lamp comprises a shouldered alumina ceramic plug 20 having a central aperture through which extends a thin-walled niobium tube 21 serving as an exhaust tube and as an inlead. Said tube extends but a short distance through the plug and is hermetically sealed therethrough by sealing composition indicated by a thick line at 22 in FIG. 2. The plug in turn has its neck portion penetrating into ceramic envelope 9 whose end abuts against the plug's shoulder portion. A hermetic seal is effected between the two parts by sealing composition indicated at 23 and 24 in FIG. 2.

Figure 2:
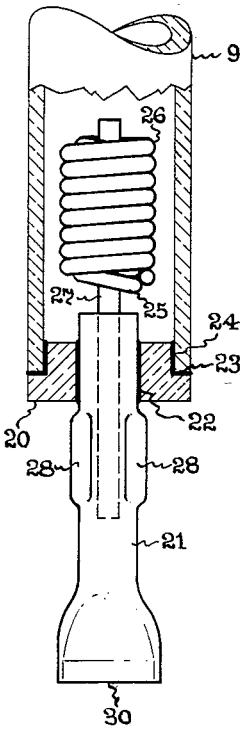
FIG. 2 is an enlarged detailed view of one electrode employed in the FIG. 1 lamp embodiment.

The present invention resides in the electrode structure itself which is depicted in greater detail for the lower electrode structure and electrode support assembly therefor as shown in FIG. 2. Specifically, said electrode structure comprises two layers of molybdenum wire 25 and 26 wound around the distal end of a tungsten shank 27 and located within the ceramic envelope. The shank extends far enough down into tube or inlead 21 that it can be securely locked in place by deforming the tube at a place outside the ceramic envelope in a manner pinching the shank over an appreciable length. Preferably the deformation is at an intermediate point in the tube which leaves a portion beyond it adequate to serve as a reservoir for excess amalgam. The illustrated crimp, sometimes known as a butterfly crimp, is of such a character, and it pinches the shank along an appreciable extent of the flattened portions or wings 28. At the same time, restricted channels (not shown) are left open on both sides of the shank to communicate with the outer portion of the exhaust tube up to the tip 30. Such communication permits passage of the sodium mercury amalgam in vapor form but prevent its movement as a liquid under ordinary operating conditions, even when the lamp is upended. In the improved electrode structure being described, the two layers of the molybdenum wire coils 25 and 26 can be wound on the shank as superposed helical layers all in a single operation, with inner layer 25 being space wound and crimp welded on the shank and then the outer layer 26 over it by backwinding in a tight fashion. In backwinding, one continues to rotate the shank in the same direction but the pitch or direction of progression of the turns is reversed so that the outer turn locks in the inner turns. Such entire winding operation may be done mechanically including dipping the backwound coils into a suspension of suitable emission material. In such electrode fabrication, the only remaining operation is that of inserting the shank of the coated electrode into the niobium tube in place for crimping. Said inner helical layer 25 is further provided with spaced apart turns for dispersion of the emission material between the spaced apart turns and with the preferred emission material being dibarium calcium tungstate. The remaining structural components of said lower electrode support assembly are depicted in FIG. 1. The arc tube itself is supported in the outer envelope by a connector 31 which is welded across from tubular inlead 21 to a support rod 32 joined to lead-in conductor 5.

The lamp performance characteristics for the above-described lamp embodiment including the presently improved composite electrode structure were measured. More particularly, lamp operating tests for the 400 watt size lamps were conducted for a performance comparison between the prior art all-tungsten electrodes and the same geometry electrodes using molybdenum coils to replace tungsten coils. The results of said comparison lamp tests are summarized in Table I below and in FIG. 3.

TABLE I

| Test | No. Lamps | Type Coils | Lumens/ Watt | Operating Volts |
|---|---|---|---|---|
| #1 | 15 | Tungsten (100 Hrs) | 119.1 | 95.8 |
| #2 | 15 | Molybdenum (100 Hrs) | 121.2 | 95.0 |
| #3 | 25 | Tungsten (100 Hrs) | 120.3 | 107.0 |
| | | Tungsten (100 Hrs) | 119.8 | 97.1 |
| #4 | 25 | Molybdenum (100 Hrs) | 122.1 | 96.9 |
| | | Molybdenum (100 Hrs) | 121.6 | 100.3 |

As evident from the above tests results, the molybdenum coil electrodes were found to be uniformly superior to the tungsten coil electrodes in providing higher lumen per watt values during the initial 100 hours of lamp operation.

Figure 3:
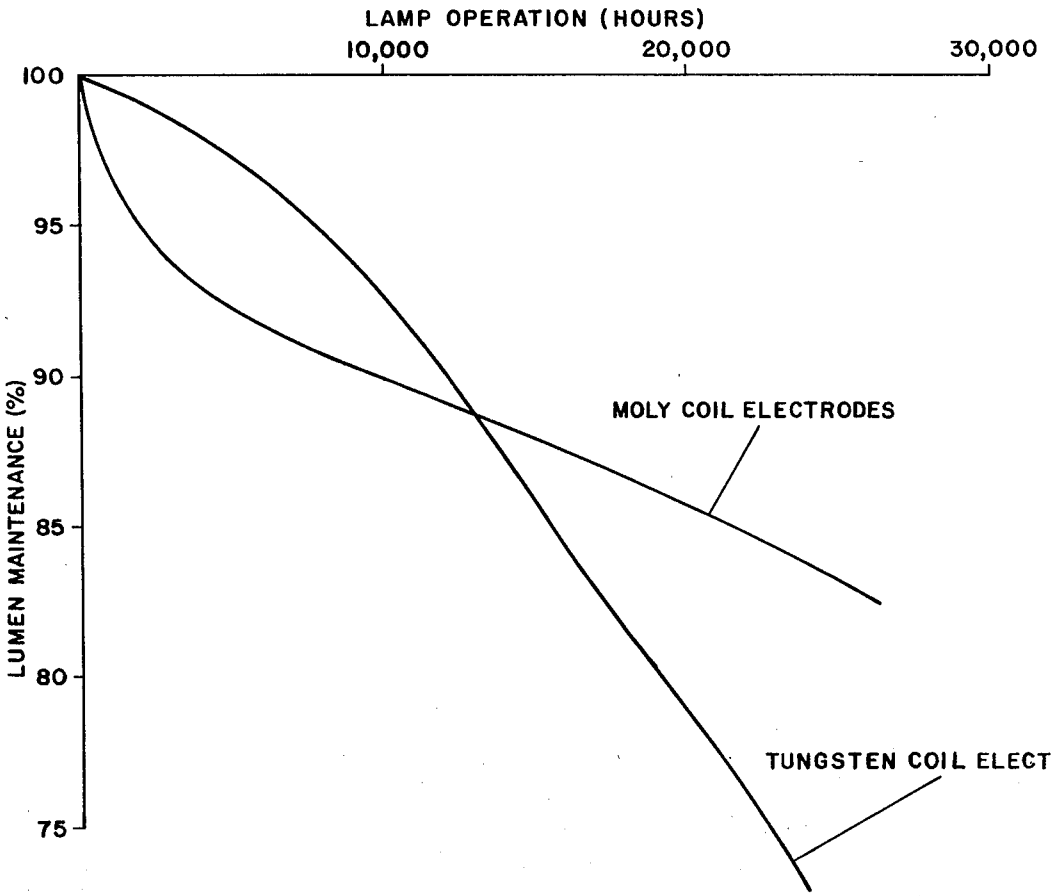
FIG. 3 is a graph depicting a lumen maintenance comparison between molybdenum and tungsten electrodes.

The distinctive lumen maintenance characteristics obtained with 400 watt size lamps in accordance with the present invention are depicted in FIG. 3. As shown, a comparison between said molybdenum coil electrodes and all-tungsten electrodes finds the final lumen depreciation for the molybdenum electrodes to be significantly less despite greater initial lumen depreciation. While the exact mechanism for this unexpected result is unknown at the present time, it may be attributable to the different behavior of these refractory metals when the lamp electrodes are constructed as well as during subsequent lamp operation. The greater ductility of molybdenum wire compared with tungsten wire permits a tighter outer coil configuration to be fabricated during electrode manufacture, as above defined, to better hold the oxide emission material and produce higher lumen output during the initial 100 hours of lamp operation. During subsequent lamp operation up to about 4,000 hours of lamp operation, there is experienced a greater rate of degradation for the molybdenum coils as compared with the tungsten coils in said particular lamp operating environment. Over still longer lamp operation, however, there is apparently experienced a much slower rate of degradation for said molybdenum electrodes and possibly accompanied by lower emission material loss such that the depicted final lumen maintenance is better than found with said tungsten electrodes.

It will be apparent from the foregoing description that an improved electrode structure for high pressure sodium vapor type lamps has been disclosed which is generally useful. It will be thereby further apparent to those skilled in the lamp art that said improved electrode structure can replace the conventional all-tungsten electrode in this type lamp although remaining features in the lamp other than above specifically disclosed are employed. For example, other end seal configurations for the ceramic arc tube than above illustrated are already known and which can utilize the present electrode improvement. Accordingly, it is intended to limit the present invention only by the scope of the following claims.

What I claim as new and desire to secure by U.S. Letters Patent is:

1. An improved high pressure sodium vapor lamp having a tubular light-transmitting ceramic envelope containing a reservoir of sodium-mercury amalgam in excess of the quantity vaporized during lamp operation with thermionic electrodes sealed into its ends and containing an inert gas filling, said sodium-mercury amalgam having been deposited in a predetermined amount in a niobium tube hermetically sealed at one end of said ceramic envelope with sealing composition, at least one of said electrodes comprising a pair of superposed helical refractory metal wire coils wound around a tungsten shank in reversed pitch direction and which said inner helical coil having spaced apart turns on which is deposited an emission material consisting essentially of dibarium calcium tungstate, the improvement wherein said refractory metal wire coils are molybdenum which cooperates in providing improved physical retention of said emission material to provide increased initial lumens together with reduced lumen depreciation after 4000 hours of lamp operation.

2. An improved high pressure sodium vapor lamp comprising:

(a) a tubular light-transmitting alumina ceramic arc tube having thermionic electrodes sealed into its ends and a reservoir of sodium-mercury amalgam in excess of the quantity vaporized in normal operation along with a xenon gas fill to facilitate starting and, said sodium-mercury amalgam having been deposited in a predetermined amount within said ceramic arc tube, (b) an evacuated outer elongated light-transmitting vitreous envelope surrounding said arc tube having a stem press seal at one end through which extends a pair of inleads electrically connected to said thermionic electrodes;

(c) said electrodes each comprising a pair of superposed helical coils of refractory metal wound around the distal end of a tungsten shank in reverse winding pitch directions and with the inner helical coils having spaced apart turns, one of said electrodes having an emission material consisting essentially of dibarium calcium tungstate being dispersed in the spaced apart turns of said inner helical coil at the end of said electrode which is located within said ceramic tube while the opposite end of said electrode comprises a tubular niobium inlead conductor hermetically sealed to said ceramic tube with sealing composition and extending externally therefrom to provide said amalgam reservoir at its external end, wherein the improvement comprises using molybdenum for said helical coils which cooperates in providing improved physical retention of said emission material to provide increased initial lumens together with reduced lumen depreciation after 4000 hours of lamp operation.

* * * * *